US005542783A

United States Patent [19]

Pollack

[11] Patent Number: 5,542,783

[45] Date of Patent: Aug. 6, 1996

[54] TLP AND DETACHABLE DERRICK VESSEL

[75] Inventor: Jack Pollack, Calabasas Hills, Calif.

[73] Assignee: Imodco, Inc., Calabasas Hills, Calif.

[21] Appl. No.: 355,609

[22] Filed: Dec. 14, 1994

[51] Int. Cl.[6] ..... E02B 17/00; B63B 35/44

[52] U.S. Cl. ..... 405/223.1; 166/352; 166/355; 405/224

[58] Field of Search ..... 405/223.1, 224, 405/209; 166/350, 358, 359, 367, 352

[56] References Cited

U.S. PATENT DOCUMENTS

| | | | |
|---|---|---|---|
| 3,078,680 | 2/1963 | Wepsala | 405/209 |
| 3,125,171 | 3/1964 | Stewart, III . | |
| 3,426,843 | 2/1969 | Visser . | |
| 4,170,266 | 10/1979 | Fayren . | |
| 4,819,730 | 4/1989 | Williford et al. . | |
| 4,913,238 | 4/1990 | Danazcko et al. . | |
| 4,987,846 | 1/1991 | Yamashita et al. . | |
| 4,995,762 | 2/1991 | Goldman . | |
| 5,190,411 | 3/1993 | Huete et al. | 405/223.1 |
| 5,195,848 | 3/1993 | Huete et al. . | |
| 5,207,534 | 5/1993 | Brasted et al. | 405/223.1 X |
| 5,342,148 | 8/1994 | Huete et al. | 405/223.1 |
| 5,423,632 | 6/1995 | Ekvall et al. | 405/223.1 |
| 5,439,321 | 8/1995 | Hunter | 405/224 X |

*Primary Examiner*—Tamara L. Graysay
*Assistant Examiner*—Frederick Lagman
*Attorney, Agent, or Firm*—Freilich Hornbaker Rosen

[57] ABSTRACT

An offshore production system of the type that includes a TLP (tension leg platform) (12) and a derrick vessel (14) which moves to the TLP platform (16) whenever the derrick is required. The vessel carries fastener assemblies (131) that rigidly fix the vessel to the platform so they move vertically and horizontally as a single unit, which avoids any need to separately anchor the vessel and which facilitates operation of the derrick in more adverse weather. The vessel preferably has thruster equipment (88) which not only allows it to self-propel itself to the platform, but which also allows the vessel to propel itself and the platform sidewardly, to avoid drift of the platform during drilling. The vessel includes a vessel deck (70) which lies above the platform and a pair of vessel sides (72, 74) with pontoons (76, 78), that lie on opposite sides of the platform. After the vessel moves to a position around the platform and is fixed to the platform, the buoyancy of the vessel is increased to add tension to the TLP tendons.

8 Claims, 4 Drawing Sheets

FIG. 4
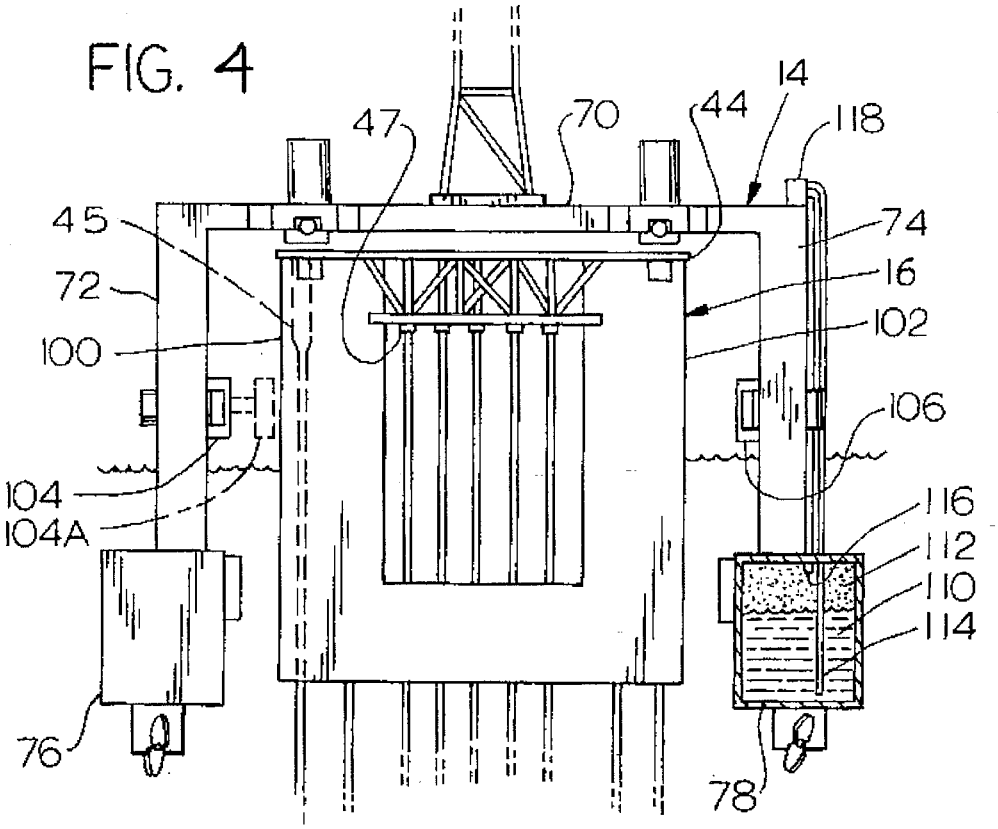
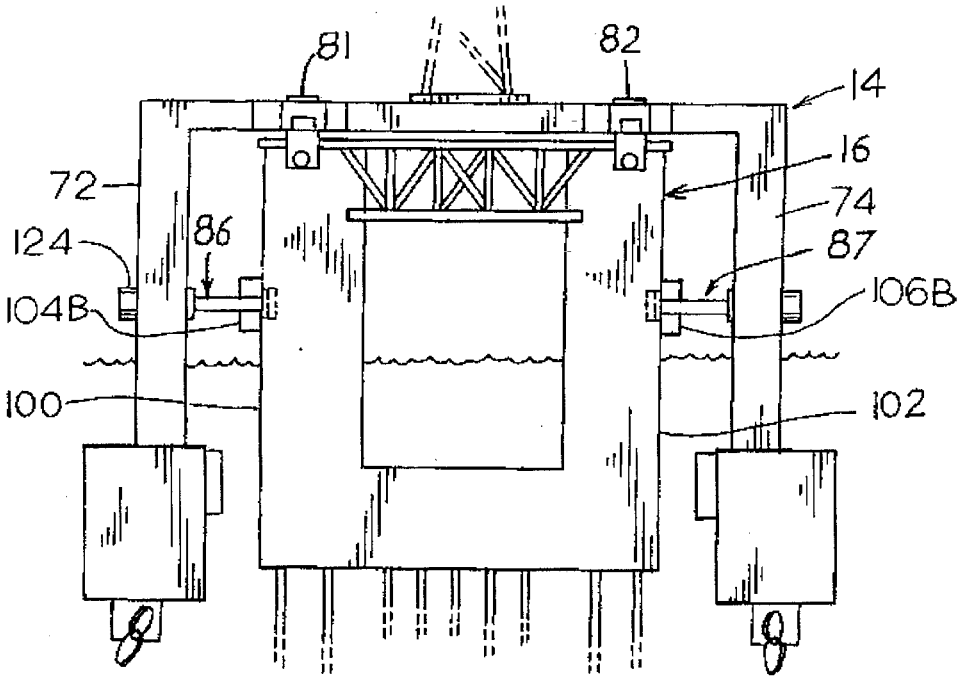
FIG. 5

TLP AND DETACHABLE DERRICK VESSEL

BACKGROUND OF THE INVENTION

Small TLP's (tension leg platforms) can be used to economically produce hydrocarbons from marginal offshore fields. Such TLP's can be made especially small compared to prior TLP's, by not providing the TLP platform with a derrick, but instead providing a servicing vessel with a derrick thereon. Whenever drilling, workover, or completion is required, which requires the use of a derrick, the vessel is moved to the platform. Whenever a storm approaches, the vessel is moved away.

U.S. Pat. No. 4,913,238 by Danazcko, describes a system of this type, wherein the vessel is towed to the TLP platform until the deck of the vessel lies above the platform and opposite sides of the vessel with pontoons thereon, lie on opposite sides of the platform. The vessel is separately moored, by catenary chains, and performs operations requiring its derrick. While such a system enables the use of relatively small TLP's, it has several disadvantages. One disadvantage is that the vessel can be used only in calm seas, or else it may vigorously strike the platform and damage both of them. Also, calm seas are usually required to operate the derrick on a platform or on the separate vessel, to assure that the platform will remain almost directly over the wells to be drilled or serviced. An offshore production system, wherein a vessel that carried a derrick to and away from a small platform could be more quickly coupled to the platform and could be used in moderately adverse weather, would be of considerable value.

SUMMARY OF THE INVENTION

In accordance with one embodiment of the present invention, an offshore production system is provided of the type wherein a vessel carries a derrick to a relatively small platform of a TLP (tension leg platform), which enables the derrick on the vessel to be used under a wide range of weather conditions. When the vessel is brought to the platform, the vessel is rigidly fixed to the platform to cause them to move together both horizontally and vertically. This avoids the need to separately moor the vessel to the sea floor and avoids damage to either one from hitting one another in turbulent seas.

The vessel preferably carries thruster equipment which permits it to move in any direction. Such equipment not only allows a vessel to propel itself to the platform, but allows the vessel to minimize movement of the platform away from its quiescent position directly over the sea floor wells, during drilling or other operations. Avoiding drift in moderately adverse weather, enables the derrick to be used under a wide variety of sea conditions, instead of only in calm seas. The vessel preferably includes an upper deck on which the derrick is mounted, and a pair of sides with pontoons that straddle the platform. Once the vessel is fixed to the platform, buoyancy can be added to the vessel to increase tension in tendons that anchor the vessel to the sea floor, so the derrick can be operated in rougher seas.

The novel features of the invention are set forth with particularity in the appended claims. The invention will be best understood from the following description when read in conjunction with the accompanying drawings.

BRIEF DESCRIPTION OF THE DRAWINGS

FIG. 4 is a rear elevation view of the system of FIG. 1, in the course of coupling the vessel to the platform.

FIG. 5 is a view similar to FIG. 4, but showing the vessel and platform after they are coupled.

DESCRIPTION OF THE PREFERRED EMBODIMENTS

Figure 1:
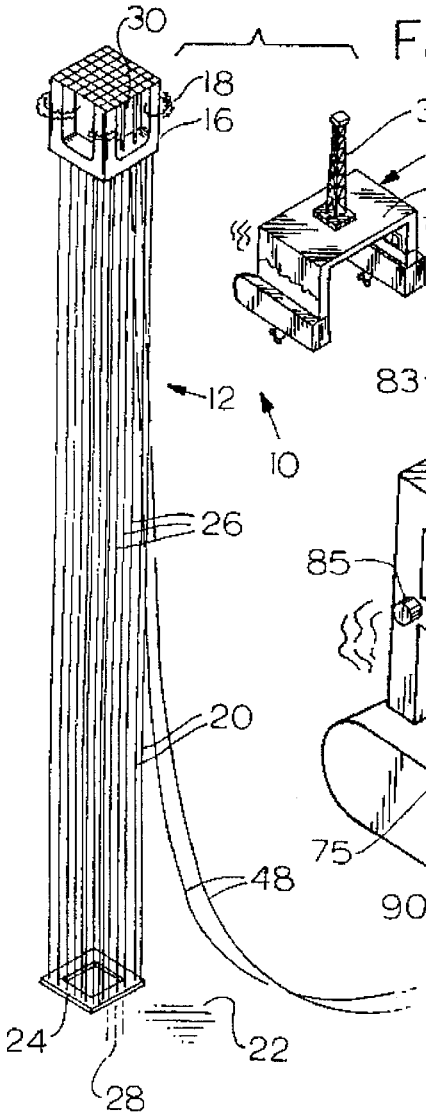
FIG. 1 is an isometric view of an offshore production system which includes a TLP (tension leg platform) and a service vessel which is approaching the platform of the TLP.

FIG. 1 illustrates an offshore production system 10 which includes a TLP (tension leg platform) 12 and a service vessel 14. The TLP includes a platform 16 constructed to float near (including at) the sea surface 18 and which is held by a plurality of tendons 20 that extend vertically to the sea floor 22. A template 24 has been attached to the sea floor and the tendons 20 are anchored to the corners of the template. A group of risers 26 extend up from undersea wells 28 to the platform, to production trees 30 on the platform. The platform 16 is of relatively small size compared to other TLP platforms, with platform 16 having an installed displacement of about 6,000 tons and a width and length that are each about 30 meters. The tendons 20 and risers 26 are under considerable tension, and prevent the platform 16 from drifting more than perhaps 8 degrees from a quiescent position wherein the platform lies directly over the template 24. Such TLP's are used in deep seas of at least 200 meters depth, where a fixed platform would be prohibitively expensive.

The platform 16 is made lightweight by minimizing equipment thereon, particularly by not providing a derrick and accessories used with it. However, a derrick and associated equipment is occasionally needed to drill the undersea wells 28 as well as to perform workover and completion operations, since all of these operations require the fitting of many long pipes in series and lowering them to the sea floor. Applicant provides a service vessel 14 that holds a derrick 32 and associated equipment (an engine to turn a drill string, etc). Whenever the services of a derrick 32 are required, the vessel is moved to the platform 16 and coupled to it. The derrick then can be used with the platform, as to drill a well or lower tools through an already-installed riser.

Figure 2:
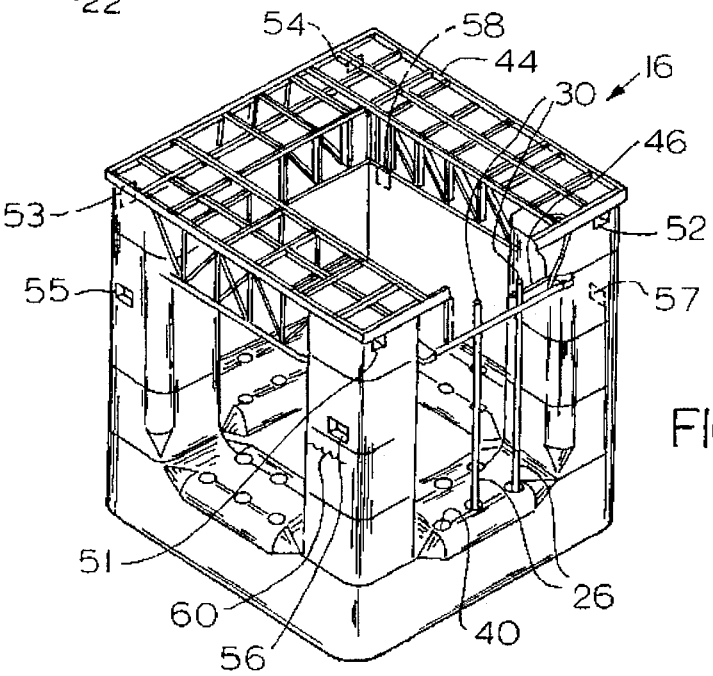
FIG. 2 is an isometric view of the platform of the TLP of FIG. 1.

FIG. 2 shows some details of the platform 16, which includes passages 40 through which risers 26 extend, and which include production trees 30 mounted on a platform deck structure 44. A production tree can have a top through which a string of pipes can be lowered, and also have fluid couplings such as 46. The coupling 46 can connect to a conduit for carrying hydrocarbons produced from the undersea wells, to a manifold and through conduits (e.g. 48 in FIG. 1) that extend to processing equipment on a distant vessel or fixed platform structure. The particular platform shown has twenty passages 40 to accommodate up to twenty risers. It also has provisions for twelve tendons arranged in groups of three at each of the four corners of the platform to hold the platform in position. Tendon holders 45 (FIG. 4) hold the tendons to the platform, and riser holders 47 hold the risers. The particular platform 16 also includes platform fastener parts in the form of piston engaging devices, including four of such devices 51–54 (FIG. 2) located near the deck 44 and four additional devices 55–58 lying at lower levels, though preferably still above the sea surface level 60 of the platform. The engaging devices are used with other parts to fix the platform to the vessel, as will be described below.

Figure 3:
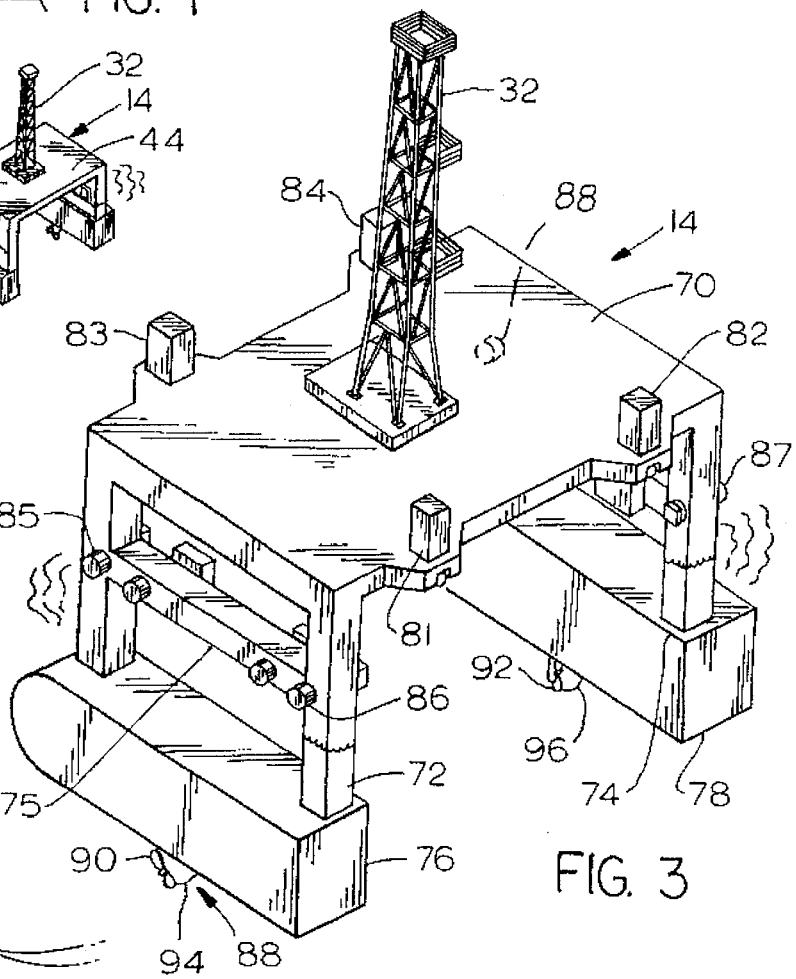
FIG. 3 is an isometric view of the service vessel of the system of FIG. 1.

FIG. 3 shows details of the vessel 14, which includes a vessel deck 70 at which the derrick 32 is mounted, and a pair of vertically-extending sides 72, 74 extending downwardly from opposite sides of the deck. Each side includes a horizontal beam 75. A pair of pontoons 76, 78 lie at lower ends of the sides to support most of the weight of the vessel. The vessel has a plurality of vessel fastener parts including upper ones 81–84 and lower ones 85–88. The vessel is self propelled, and includes thruster equipment 88 for this purpose. The thruster equipment includes two propellers 90, 92 that are each mounted on a post 94, 96 that can be rotated about a corresponding vertical axis to drive the vessel in any direction.

FIG. 4 shows the vessel 14 after it has moved to a position wherein the vessel deck 70 lies directly above the platform deck 44, and with the vessel lying astride the platform with vessel sides 72, 74 lying on opposite sides of platform sides 100, 102. Applicant extends side bumpers 104, 106 to position such as shown at 104A to limit relative sideward movement of the platform and vessel.

Figure 7:
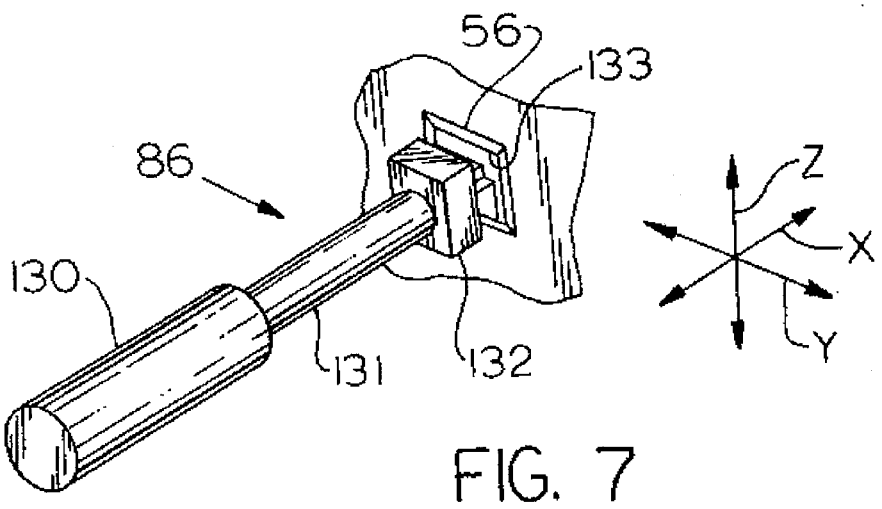
FIG. 7 is a simplified isometric view of the system of FIG. 5, showing the fasteners that fix the vessel to the platform.
Figure 8:
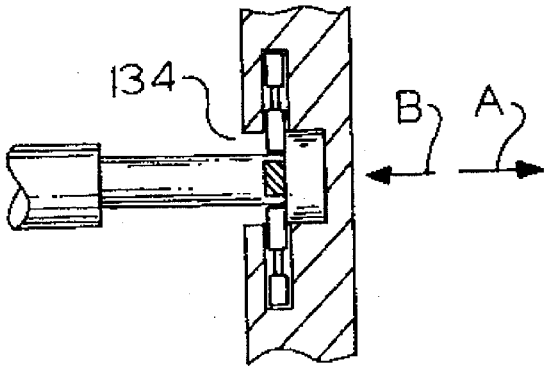
FIG. 8 is a partial top view of the system of FIG. 7.
Figure 9:
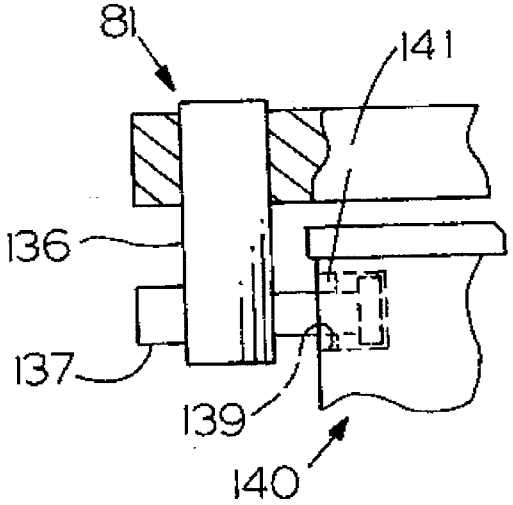
FIG. 9 is a view of one of the fasteners of FIG. 8.

To fix the vessel to the platform, applicant operates all of the vessel fastener parts 81–84 and 85–88. FIGS. 7–9 show examples of the fastener parts, although a variety of fasteners can be used. As shown in FIG. 7, each of the lower vessel fastener parts such as 86 includes a hydraulic cylinder 130 which can thrust a piston 131 with an enlarged head 132 into an opening 133 at a platform fastener part 56. FIG. 8 shows that after the piston head enters the opening 133, a group of latches 134 on the platform are moved behind the piston head to trap it and prevent relative movement in directions A and B. FIG. 9 shows an upper vessel fastener part 81 which includes a support 136 that can be lowered (as by another hydraulic cylinder) until a hydraulic cylinder 137 is positioned with its piston 138 aligned with an opening 139 at a platform fastener part 140. The cylinder is operated to thrust the piston into the opening, where the piston is locked by latches 141 of the vessel fastener part.

When all fastener parts on the vessel and/or platform are operated, the vessel is fixed to the platform against movement in three direction X, Y, Z as well as against rotation about any axis extending along these three directions.

After the vessel is fixed to the platform, it is advantageous to increase the buoyancy of the vessel and platform combination, to increase tension in the tendons 20 that anchor the platform. The increased tendon tension will prevent the tendons from going slack and whipping against each other or a riser, when waves strike the vessel, which has a large profile.

FIG. 4 shows a pair of pipes 114, 116 extending from ballast adjusting equipment 118 on the vessel deck down to pontoon 78. The equipment 118 can pump gas such as air down through the pipe 116, to cause water to flow up through pipe 114 to the equipment, from which the water is allowed to flow into the sea. The resulting increase in buoyancy does not significantly raise the vessel and platform, but does increase tendon tension. Later, when the vessel gets ready to move away from the platform, the equipment 118 pumps liquid such as water down through the pipe 114 while allowing air to escape through pipe 116. Then the vessel is detached from the platform and sails away.

By fixing the platform and vessel together, Applicant avoids the need to separately moor the vessel. Any such separate mooring would permit use of the vessel only in calm seas (to prevent the vessel and platform from hitting each other). By fixing the platform and vessel together, applicant can keep them together and perform servicing operations, including inspection and repairs by personnel transported on the vessel, as well as operation of the derrick for downhole servicing. Also, the vessel can remain fixed to the platform even in moderately turbulent seas, where relative movement could cause a loosely coupled platform and vessel to forcefully strike one another. When a storm approaches, however, the vessel should be detached from the platform and sailed away, since the vessel with its upstanding derrick is not constructed to withstand storms of medium to high intensity. The self propulsion of the vessel permits it to leave without waiting for a towing vessel. The fact that the vessel does not have to be separately moored, but only has to be fixed to the platform, results in operations to hold and then fix the vessel to the platform requiring only a few hours, instead of a few days for separate mooring of the vessel. The vessel can approach and dock in seas with waves up to about 1.5 meters height, and can move away in seas with waves of up to about 3 meters height.

Figure 6:
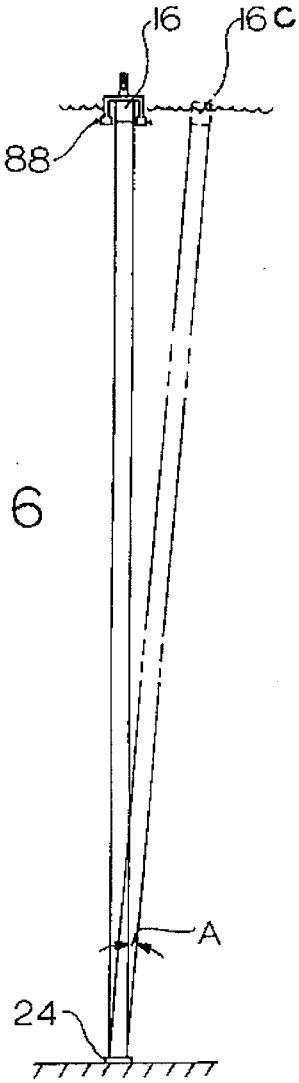
FIG. 6 is a rear view of the system of FIG. 5, showing the manner in which the vessel minimizes drift of the platform.

When the seas are not calm, and especially when there are strong currents, the platform will usually experience substantial drift. FIG. 6 shows the platform at 16C when it has drifted by an angle A (5°) of several degrees away from its quiescent position shown at 16. Whenever the derrick is used to drill or provide workover or completion, it is usually desirable that the platform lie directly over the template 24. Applicant's use of a vessel 14 with thruster equipment 88, enables the crew on the vessel to keep the platform directly over the template even when there are significant currents. Equipment is well known for determining the position of the vessel or platform with respect to the sea floor. By using a vessel with thrusters that can move the vessel towards either side as well as forward or rearward, applicant is able to perform downhole operations including drilling, workover and completion during a wider range of weather conditions than without such thruster equipment.

Figure 10:
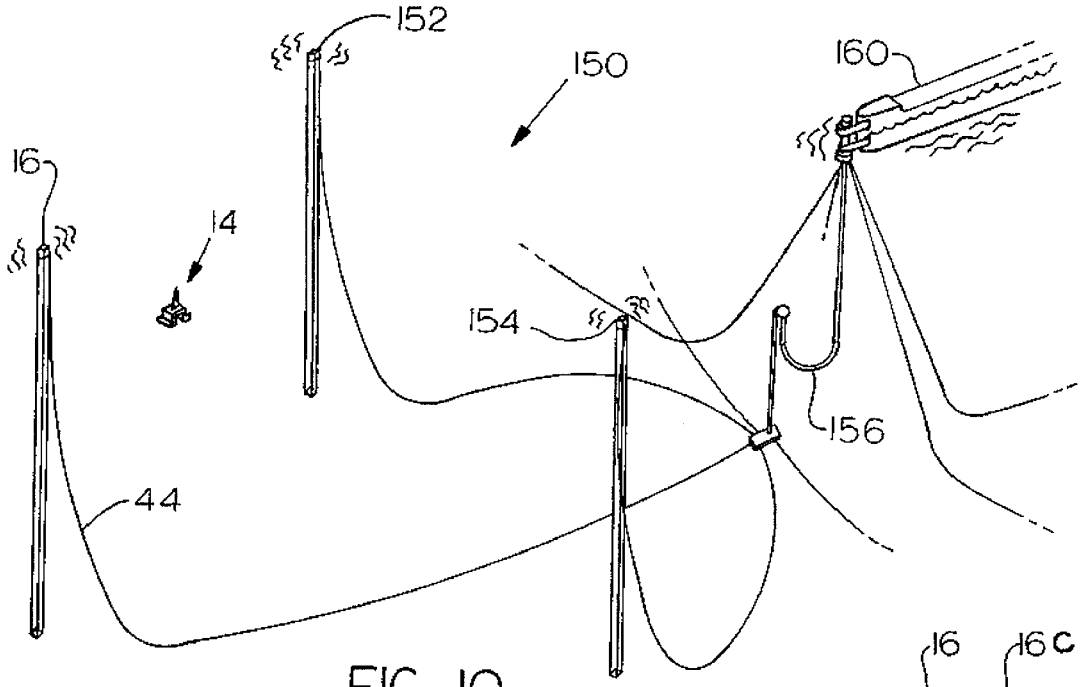
FIG. 10 is an isometric view of a system in accordance with the present invention, which includes the TLP and vessel of FIG. 1.

FIG. 10 illustrates a system 150 which includes the platform 16 and other platforms or platform devices including two shown at 152 and 154. In this system, each of the platforms is used to produce hydrocarbons from different sections of a field, with all platforms lying within 80 kilometers of one another. The outputs of all platforms are connected through a conduit 156 that leads to a processing and storage ship 160. This system may include ten or more platforms, and the servicing vessel 14 is used to service them. The fact that the service vessel 14 can perform downhole services of drilling, workover and completion during a variety of weather conditions, enables a single service vessel 14 to service a large number of platforms such as ten of them.

Figure 11:
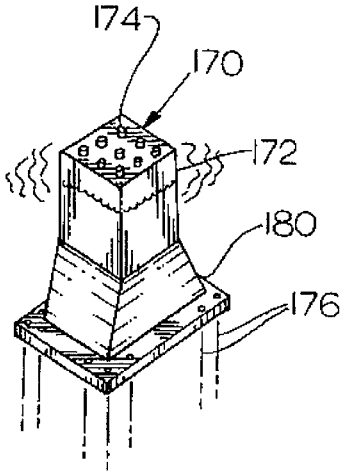
FIG. 11 is a partial isometric view of a TLP platform constructed in accordance with another embodiment of the invention.

FIG. 11 illustrates another platform 170 which has an upper portion 172 of reduced width. A group of production trees 174 lie at the platform upper portion. Tendons 176 are fastened to a lower portion 180 of the platform. Provisions are made to fasten the upper ends of the risers near the bottom of the platform to avoid large changes in riser and tendon tension when the platform drifts under the influence of large currents. The narrower upper portion 172 enables the use of a servicing vessel of smaller width.

Thus, the invention provides an offshore production system wherein a servicing vessel can be moved to a platform of a TLP to service it, which decreases the time for vessel docking and which enables the vessel to service the TLP during a wider range of weather conditions. The vessel and platform have fastener parts, or portions of fastener assemblies, that enable the platform to be fixed to the platform so they move in unison both vertically and horizontally. This reduces the time for vessel docking and permits the vessel to continue servicing the platform during a wider range of weather conditions. The vessel preferably has thruster equipment, so it can minimize platform drift, to further permit servicing during a considerable range of weather conditions. The vessel has pontoons whose buoyancy can be varied, so after fixing to the platform the vessel buoyancy can be increased to increase platform tendon tension and allow operation in rougher seas.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. An offshore production system comprising a TLP which includes a platform that has first and second opposite sides and that is constructed to float near the sea surface and which has a platform deck, wherein said platform has a plurality of tendon holders constructed to hold tendons that extend down to the sea floor to anchor the platform and a plurality of riser holders constructed to hold risers that extend down to the sea floor to carry fluid, and which also includes a service vessel which has first and second opposite sides and which has a vessel deck and a derrick on said vessel deck wherein said vessel is constructed to move to a position astride said platform wherein said vessel deck and said derrick thereon lie over said platform deck with a portion of said first side of said vessel lying beyond said first side of said platform and a portion of said second side of said vessel lying beyond said second side of said platform, characterized by:

a plurality of fastener assemblies coupled to said platform and said vessel, said fastener assemblies being constructed to fix said first sides of said platform and said vessel together and to fix said second sides of said platform and said vessel together:

said platform and said vessel being sufficiently rigidly fixed at each of their sides against relative vertical movement that said vessel and said platform move vertically together in waves.

2. The system described in claim 1 wherein:

said vessel is free of anchoring to said sea floor except through said platform.

3. The system described in claim 1 wherein:

said vessel has a pair of pontoons for lying on opposite sides of said platform, and wherein:

said pontoons of said vessel have floodable chambers and said vessel has water and air flowing equipment that is operable when said vessel is fixed to said platform, to flow air into said chambers to pump out water and thereby increase the buoyancy of said vessel and increase tendon tension.

4. The system described in claim 1 including:

a plurality of platform devices, said platform and said platform devices each anchored to the sea floor;

said platform and said plurality of platform devices all being substantially identical so said vessel can move to and fix itself to any one of said platform devices in addition to said platform.

5. An offshore production system comprising:

a TLP which includes a platform floating near the sea surface and a plurality of tendon holders for holding tendons that can extend down from said platform to the sea floor;

a service vessel which has a hull, a deck, and a derrick mounted on said deck;

a plurality of fastener assemblies that rigidly fix said platform to said vessel so they move together both vertically and horizontally in waves, with said derrick lying over said platform.

6. A method for use with a TLP that includes a platform floating at the sea surface and that also includes a plurality of tendons extending from the platform down to the sea floor, where a derrick is not mounted on said TLP but where a derrick is mounted on a vessel that has opposite sides and a space between said sides, comprising:

moving said vessel with said derrick thereon to a position astride said platform;

rigidly fixing said vessel to said platform, so they move in unison in both vertical and horizontal directions.

7. The method described in claim 6 wherein said platform has a top and has a width, and said vessel includes a pair of sides with pontoons, said sides being spaced apart by more than said platform width, and said vessel includes a vessel deck supported on said sides, with said derrick mounted on said deck and with said pontoons having chambers which can hold air and/or water, including:

with said vessel fixed to said platform, withdrawing water from at least portions of said pontoon chambers to increase tendon tension.

8. An offshore production system lying in a sea that has a sea floor, comprising:

a TLP which includes a platform that has first and second opposite sides and that lies in said sea, and a plurality of tendons and at least one riser all extending substantially vertically from substantially said sea floor to said platform;

a service vessel which has first and second opposite sides, said vessel having a deck and a derrick on said deck, said vessel positioned astride said platform with said deck lying over said platform, with said vessel first side having a portion lying beyond said platform first side, and said vessel second side having a portion lying beyond said platform second side;

a plurality of fasteners, each connecting said vessel to said platform and preventing relative vertical movement of said vessel to said platform.

* * * * *